US010174646B2

(12) United States Patent
Asahi et al.

(10) Patent No.: US 10,174,646 B2
(45) Date of Patent: Jan. 8, 2019

(54) VALVE OPENING AND CLOSING TIMING CONTROL APPARATUS

(71) Applicant: AISIN SEIKI KABUSHIKI KAISHA, Kariya-shi, Aichi-ken (JP)

(72) Inventors: Takeo Asahi, Kariya (JP); Yuji Noguchi, Obu (JP); Hideyuki Suganuma, Anjo (JP); Hiroyuki Hamasaki, Obu (JP); Toru Sakakibara, Kariya (JP); Tomohiro Kajita, Kariya (JP); Kazuya Saito, Kariya (JP); Yusuke Maekawa, Aichi-ken (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 92 days.

(21) Appl. No.: 15/277,173

(22) Filed: Sep. 27, 2016

(65) Prior Publication Data

US 2017/0175593 A1 Jun. 22, 2017

(30) Foreign Application Priority Data

Dec. 21, 2015 (JP) ..... 2015-249013

(51) Int. Cl.
*F01L 1/34* (2006.01)
*F15B 13/04* (2006.01)
(Continued)

(52) U.S. Cl.
CPC ..... *F01L 1/3442* (2013.01); *F01L 1/047* (2013.01); *F01L 1/34* (2013.01); *F02D 13/0219* (2013.01);
(Continued)

(58) Field of Classification Search
CPC ... F01L 1/3442; F01L 1/34; F01L 2001/3443; F01L 2001/34433; F01L 1/053;
(Continued)

(56) References Cited

U.S. PATENT DOCUMENTS 6,523,513 B2 2/2003 Speier
7,222,598 B2 5/2007 Hayashi
(Continued)

FOREIGN PATENT DOCUMENTS

CN 103339348 A 10/2013
JP 2002-295208 A 10/2002
JP 2012-172558 A 9/2012

OTHER PUBLICATIONS

JP 2012-172558 English Language Machine Translation.*
(Continued)

*Primary Examiner* — Mark A Laurenzi
*Assistant Examiner* — Wesley G Harris
(74) *Attorney, Agent, or Firm* — Buchanan Ingersoll & Rooney PC

(57) ABSTRACT

A valve opening and closing timing control apparatus includes: a driving side rotor synchronously rotating with a crankshaft of an internal combustion engine; a driven side rotor disposed coaxially with a rotary axis of the driving side rotor and synchronously rotating with a camshaft; a connecting bolt disposed coaxially with the rotary axis, and connecting the driven side rotor to the camshaft; and a position determination unit performing positioning between the driven side rotor and the camshaft, or in a case where an intermediate member is provided between the driven side rotor and the camshaft, between the driven side rotor and the intermediate member, or between the camshaft and the intermediate member, wherein the position determination
(Continued)

unit includes an engaging pin, first and second hole portions, and a deformation absorbing unit.

9 Claims, 7 Drawing Sheets

(51) Int. Cl.

| | |
|---|---|
| ***F02D 13/02*** | (2006.01) |
| ***F01L 1/047*** | (2006.01) |
| ***F01L 1/344*** | (2006.01) |
| *F01L 1/053* | (2006.01) |
| *F01L 13/00* | (2006.01) |

(52) U.S. Cl.
CPC ... *F15B 13/0402* (2013.01); *F01L 2001/0537* (2013.01); *F01L 2001/3443* (2013.01); *F01L 2001/3444* (2013.01); *F01L 2001/34423* (2013.01); *F01L 2001/34426* (2013.01); *F01L 2001/34433* (2013.01); *F01L 2001/34453* (2013.01); *F01L 2001/34469* (2013.01); *F01L 2001/34479* (2013.01); *F01L 2001/34483* (2013.01); *F01L 2013/111* (2013.01); *F01L 2201/00* (2013.01); *F01L 2250/02* (2013.01)

(58) Field of Classification Search
CPC ..... F01L 2001/0537; F01L 2001/34423; F01L 2001/34426; F01L 2001/34483; F01L 2201/00; F01L 1/3443; F01L 1/34433; F15B 13/0402; F02D 13/0219
USPC ..... 123/90.15–90.17
See application file for complete search history.

(56) References Cited

U.S. PATENT DOCUMENTS

| | | | | |
|---|---|---|---|---|
| 8,910,604 | B2 | 12/2014 | Adachi et al. | |
| 8,910,605 | B2 | 12/2014 | Adachi et al. | |
| 2013/0247855 | A1* | 9/2013 | Adachi ..... | F01L 1/3442 123/90.15 |

OTHER PUBLICATIONS

Office Action (Notification of the 1st Office Action) dated Sep. 5, 2018, by the State Intellectual Property Office (SIPO) of the People's Republic of China in corresponding Chinese Patent Application No. 201610957557.3 and an English Translation of the Office Action (12 pages).

* cited by examiner

VALVE OPENING AND CLOSING TIMING CONTROL APPARATUS

CROSS REFERENCE TO RELATED APPLICATIONS

This application is based on and claims priority under 35 U.S.C. § 119 to Japanese Patent Application 2015-249013, filed on Dec. 21, 2015, the entire contents of which are incorporated herein by reference.

TECHNICAL FIELD

This disclosure relates to a valve opening and closing timing control apparatus to be provided with a driving side rotor that synchronously rotates with a crankshaft of an internal combustion engine and a driven side rotor that synchronously rotates with a camshaft of the internal combustion engine.

BACKGROUND DISCUSSION

An apparatus with a configuration enclosing a driven side rotor relatively rotatable with respect to a driving side rotor as a valve opening and closing timing control apparatus, connects and fixes the driven side rotor to a camshaft by a connecting bolt, and thus the camshaft and the driven side rotor are maintained at a determined relative phase relationship and the driving side rotor is relatively rotatably supported to the camshaft.

In JP 2002-295208A (Reference 1) as a specific example of the valve opening and closing timing control apparatus with such a configuration, a technology is disclosed in which a pin press-fitted into an end surface of a camshaft is inserted in a positioning hole of a driven side rotor in order to determine the relative phase relationship between the camshaft and the driven side rotor (vane rotor).

In JP 2006-183590A (Reference 2), a technology in which a camshaft and a driven side rotor (vane rotor) are connected via a press-fitted member and a positioning pin is fitted between the press-fitted member and the driven side rotor is disclosed.

Furthermore, JP 2012-172558A (Reference 3) has a configuration in which a connecting member is sandwiched between a camshaft and a driven side rotor (internal rotor). In Reference 3, a technology is disclosed in which a pin that passes through a pin inserting hole of the connecting member is provided, one end of the pin is inserted in the pin inserting hole of the driven side rotor, and the other end of the pin is inserted in the pin inserting hole of the camshaft.

In the apparatus that is provided with the pin which is fitted in the driven side rotor and the camshaft as illustrated in Reference 1, a relative rotational phase can be appropriately set in a case of connecting the driven side rotor to the camshaft by the connecting bolt.

However, in the apparatus in which the pin is press-fitted into the camshaft as illustrated in Reference 1, the vicinity of a portion of the camshaft where the pin is inserted is deformed in some cases by the press fitting. In a case where deformation is caused in this manner, a portion of a threaded hole portion of the camshaft is reduced in diameter due to the deformation, and thus an insertion of the connecting bolt becomes difficult, or an engagement with a male screw is not smoothly performed. Therefore, there is room for improvement.

In the configuration in which an intermediate member in contact with an end surface of the driven side rotor is provided and the pin is fitted between the intermediate member and the driven side rotor as illustrated in Reference 2 or Reference 3, it is considered that in a case of adopting the configuration in which the pin is press-fitted into one of hole portions of the driven side rotor and the intermediate member, deformation is caused in the same way as described above and the insertion of the connecting bolt is difficult.

Specifically, an advance angle flow passage communicating with an advance angle chamber and a retard angle flow passage communicating with a retard angle chamber are formed in the driven side rotor, and thus in a case where the pin is press-fitted into the driven side rotor, it is considered that a sectional area of the flow passage is reduced due to the deformation and deterioration of a response performance is caused.

Although it is considered to increase accuracy between an outer diameter of the pin and an inner diameter of a hole portion into which the pin is press-fitted to eliminate such inconvenience, in a case of performing processing with high precision, an increase in cost is caused, and thus there is room for improvement.

In a configuration in which positioning is performed using a pin, dropping of the pin is prevented by press-fitting the pin into one member and the pin is stably held, and thus transition to a process when the pin is inserted in a hole portion formed in the other member is easily performed.

For this reason, when connecting members configuring a valve opening and closing timing control apparatus to each other in a positioning state, it is required to eliminate the inconvenience caused by press-fitting of an engaging pin. Specifically, in a case where a member such as a rotor into which the engaging pin is press-fitted is low strength material such as aluminum, deformation is large at the time of the press-fitting, and thus the deformation becomes a problem.

SUMMARY

A valve opening and closing timing control apparatus according to an aspect of this disclosure includes a driving side rotor that synchronously rotates with a crankshaft of an internal combustion engine, a driven side rotor that is disposed coaxially with a rotary axis of the driving side rotor and synchronously rotates with a camshaft for valve opening and closing, a connecting bolt that is disposed coaxially with the rotary axis, and connects the driven side rotor to the camshaft, and a position determination unit that performs positioning between the driven side rotor and the camshaft, or in a case where an intermediate member is provided between the driven side rotor and the camshaft, between the driven side rotor and the intermediate member, or between the camshaft and the intermediate member. The position determination unit includes an engaging pin that is in a posture parallel to the rotary axis, a first hole portion into which one end of the engaging pin is fitted is provided in any one of two members performing the positioning, a second hole portion in which the other end of the engaging pin is inserted is provided in the other one, and a deformation absorbing unit that suppresses deformation at a time when the engaging pin is fitted is provided in the vicinity of the first hole portion.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, an embodiment disclosed here will be described with reference to drawings.

Basic Configuration

Figure 1:
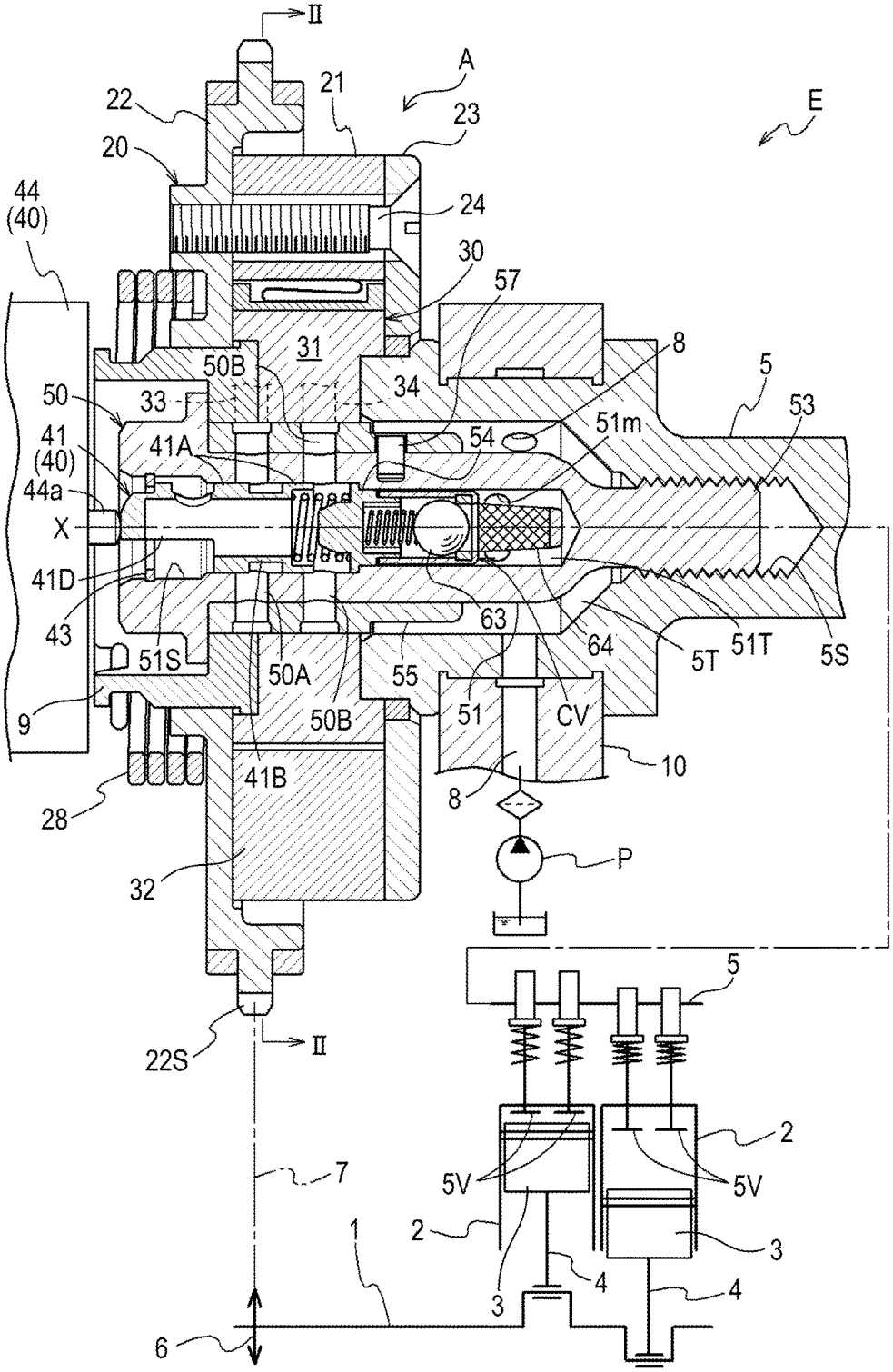
FIG. 1 is a cross-sectional view illustrating an entire configuration in a valve opening and closing timing control apparatus.
Figure 2:
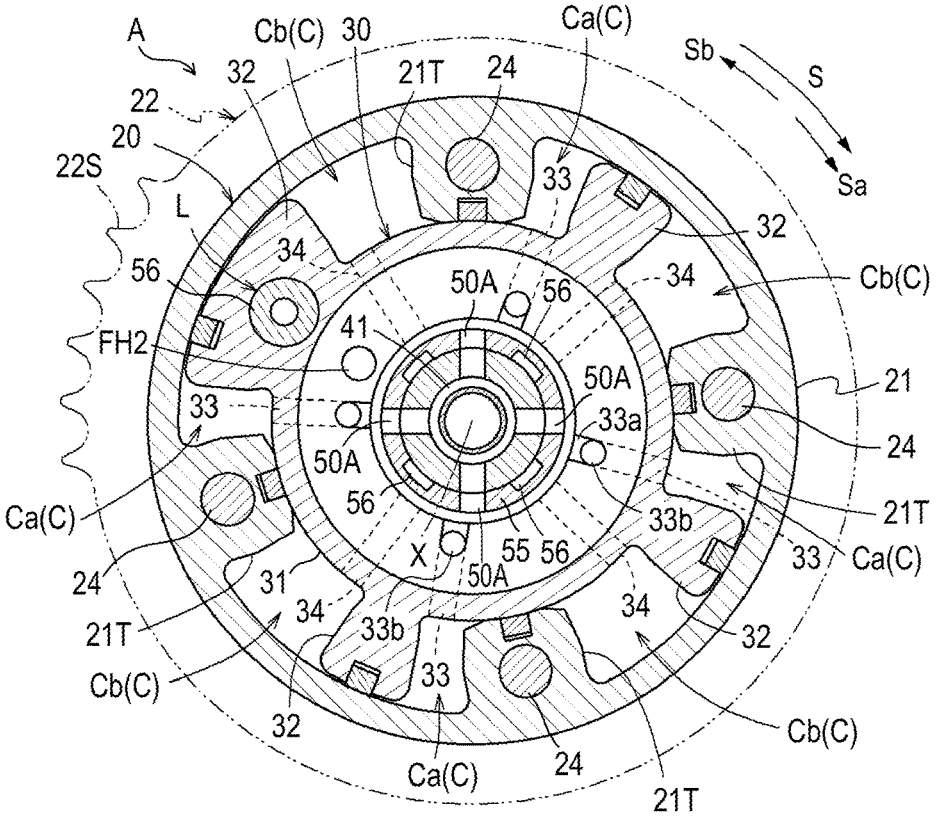
FIG. 2 is a sectional view taken along line II-II in FIG. 1.
Figure 3:
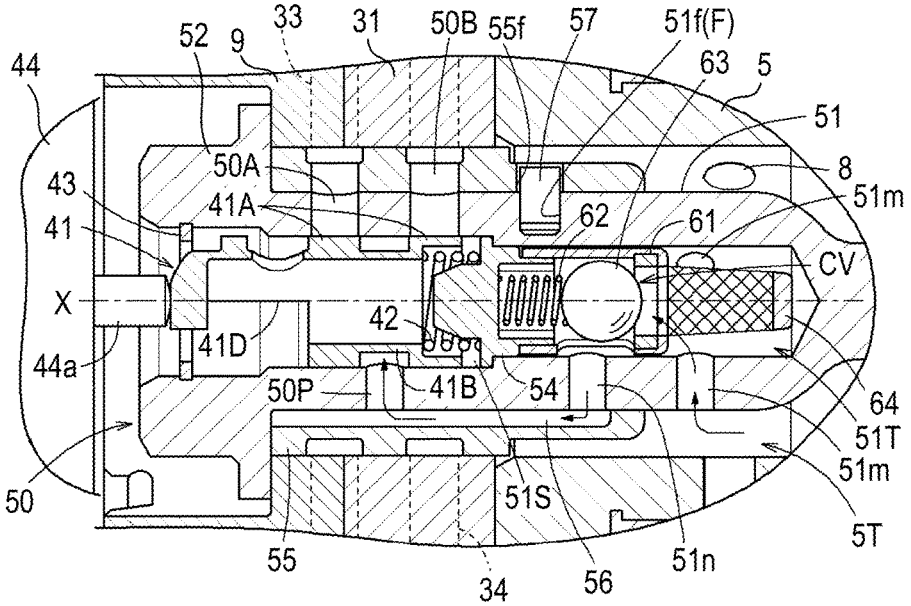
FIG. 3 is a sectional view illustrating a spool in a neutral position.

As illustrated in FIG. 1 to FIG. 3, a valve opening and closing timing control apparatus A is configured to include an external rotor 20 as a driving side rotor, an internal rotor 30 as a driven side rotor, and a solenoid control valve 40 controlling a hydraulic oil as a working fluid.

The internal rotor 30 (one example of the driven side rotor) is disposed coaxially with a rotary axis X of an intake camshaft 5, and is screwed and connected to the intake camshaft 5 by a connecting bolt 50 so as to rotate integrally. The external rotor 20 (one example of the driving side rotor) is disposed coaxially with the rotary axis X, and is relatively rotatably supported to the internal rotor 30 by containing the internal rotor 30. The external rotor 20 synchronously rotates with a crankshaft 1 of an engine E as an internal combustion engine.

The solenoid control valve 40 is provided with an electromagnetic solenoid 44 supported by the engine E, and is provided with a spool 41 and a spool spring 42 accommodated in a spool chamber 51S of the connecting bolt 50.

The electromagnetic solenoid 44 is provided with a plunger 44*a* disposed at the coaxial core with the rotary axis X so as to abut on an outer end portion of the spool 41, and sets the amount of projection of the plunger 44*a* to set an operation position of the spool 41 by control of electric power to be supplied to the inside of a solenoid. Thereby, a relative rotational phase of the external rotor 20 and the internal rotor 30 is set by controlling the hydraulic oil (one example of the working fluid). Therefore, control of an opening and closing timing of an intake valve 5V is realized.

Engine and the Valve Opening and Closing Timing Control Apparatus.

The engine E (one example of the internal combustion engine) of FIG. 1 indicates an engine that is provided in a vehicle such as a passenger car. The engine E accommodates a piston 3 in the inside of a cylinder bore in a cylinder block 2 of the upper position, and is configured with four-cycle type to connect the piston 3 and the crankshaft 1 with a connecting rod 4. The intake camshaft 5 opening and closing the intake valve 5V and an exhaust camshaft (not illustrated) are provided in upper side of the engine E.

In an engine constituting member 10 rotatably supporting the intake camshaft 5, a supply flow passage 8 is formed to supply the hydraulic oil from a hydraulic pump P (one example of the fluid pressure pump) driven by the engine E. The hydraulic pump P supplies lubricating oil stored in the oil pan of the engine E to the solenoid control valve 40 as the hydraulic oil (one example of the working fluid) via the supply flow passage 8.

A timing chain 7 is wound over an output sprocket 6 formed in the crankshaft 1 of the engine E and the timing sprocket 22S of the external rotor 20. Thereby, the external rotor 20 synchronously rotates with the crankshaft 1. A sprocket is provided to the front end of the exhaust camshaft of exhaust side, and the timing chain 7 is wound in the sprocket.

As illustrated in FIG. 2, the external rotor 20 rotates toward a driving rotational direction S by the driving force from the crankshaft 1. The direction in which the internal rotor 30 is relatively rotated in the same direction as the driving rotational direction S with respect to the external rotor 20 is referred to as an advance angle direction Sa, and the reverse direction thereof is referred to as a retard angle direction Sb. In the valve opening and closing timing control apparatus A, relationship between the crankshaft 1 and the intake camshaft 5 is set so as to increase an intake air compression ratio in accordance with increase of the amount of displacement when the relative rotational phase is displaced in the advance angle direction Sa, and so as to reduce the intake air compression ratio in accordance with the increase of the amount of displacement when the relative rotational phase is displaced in the retard angle direction Sb.

Although the valve opening and closing timing control apparatus A is provided in the intake camshaft 5 in the embodiment, the valve opening and closing timing control apparatus A may be provided in the exhaust camshaft, or may be provided in both of the intake camshaft 5 and the exhaust camshaft.

The external rotor 20 includes the external rotor main body 21, a front plate 22, and a rear plate 23, and these portions are integrated by engagement of a plurality of fastening bolts 24. The timing sprocket 22S is formed on an outer periphery of the front plate 22. An intermediate member 9 is disposed on an inner periphery of the front plate 22, and a bolt head 52 of the connecting bolt 50 is crimped with respect to the intermediate member 9. Therefore, the intermediate member 9, the internal rotor main body 31, and the intake valve 5V are integrated.

Rotor Configuration

A plurality of projecting portions 21T projecting towards the inside in a radial direction is integrally formed in the external rotor main body 21. The internal rotor 30 includes the cylindrical internal rotor main body 31 which is brought into close contact with the projecting portion 21T of the external rotor main body 21, and four vane portions 32 which project towards the outside in the radial direction from the outer periphery of the internal rotor main body 31 so as to come into contact with an inner peripheral surface of the external rotor main body 21.

Thereby, the external rotor 20 contains the internal rotor 30, and the plurality of the fluid pressure chambers C are formed on the outer periphery side of the internal rotor main body 31 at an intermediate position of the projecting portion 21T adjacent to each other in the rotation direction. These fluid pressure chambers C are partitioned by the vane portion 32, and an advance angle chamber Ca and a retard angle chamber Cb are partitioned and formed. A plurality of advance angle flow passages 33 (four) communicating with the advance angle chamber Ca are formed in the internal rotor 30, and a plurality of retard angle flow passages 34 (four) communicating with the retard angle chamber Cb are formed in the internal rotor 30.

As illustrated in FIG. 1, a torsion spring 28 assisting a displacement of the relative rotational phase between the external rotor 20 and the internal rotor 30 (hereinafter, referred to as the relative rotational phase) to the advance angle direction Sa by the action of biasing force from most retarded angle phase to the advance angle direction Sa is provided over the external rotor 20 and the intermediate member 9.

A locking mechanism L locking (fixing) the relative rotational phase between the external rotor 20 and the internal rotor 30 in the most retarded angle phase is provided. The locking mechanism L is configured to be provided with a locking member 26 supported freely movable in the direction along the rotary axis X with respect to the one vane portion 32, a locking spring (not illustrated) projected and biased the locking member 26, and a locking recess portion (not illustrated) formed on the rear plate 23. The locking mechanism L may be configured to be provided with the locking member 26 guided so as to be moved along a radial direction.

The relative rotational phase reaches the most retarded angle phase. Therefore, the locking member 26 is engaged with the locking recess portion by the biasing force of the locking spring, and the locking mechanism L serves to maintain the relative rotational phase to the most retarded angle phase. In a case where the advance angle flow passage 33 communicates with the locking recess portion, and the hydraulic oil is supplied to the advance angle flow passage 33, the locking mechanism L is also configured to perform lock releasing to detach the locking member 26 from the locking recess portion by a hydraulic oil pressure.

Connecting Bolt

As illustrated in FIG. 1 to FIG. 6, the connecting bolt 50 is provided with a bolt body 51 of which a portion is cylindrical, a cylindrical sleeve 55 fitted in a cylindrical portion of the bolt body 51, and a regulation pin 57 as an engagement member positioning these portions.

In the intake camshaft 5, a female threaded portion 5S is formed around the rotary axis X, and an inside space of the shaft 5T as a larger diameter than the female threaded portion 5S is formed so that the sleeve 55 is tightly fitted. The inside space of the shaft 5T communicates with the supply flow passage 8 as described above. The hydraulic oil is supplied from the hydraulic pump P to the inside space of the shaft 5T.

The bolt head 52 is formed on the outer end portion of the bolt body 51 and a male threaded portion 53 is formed on an inner end portion. Based on the configuration, the male threaded portion 53 of the bolt body 51 is screwed to the female threaded portion 5S of the intake camshaft 5, and the internal rotor 30 is fastened to the intake camshaft 5 by rotational operation of the bolt head 52. In the fastening state, an inner end side of the outer periphery (male screw side) of the sleeve 55 being fitted in the bolt body 51 is in close contact with the inner peripheral surface of the inside space of the shaft 5T, and the outer peripheral surface of an outer end side (bolt head side) of the sleeve 55 is in close contact with the inner peripheral surface of the internal rotor main body 31.

In the inside of the bolt body 51, the hole-shaped inner space is formed towards in the direction of the male threaded portion 53 from the bolt head 52, a retainer 54 is press-fitted and fixed to the inner space. Therefore, the inner space is divided by the retainer 54, and the spool chamber 51S and a hydraulic oil chamber 51T as a fluid chamber are formed in a non-communicated state.

The spool chamber 51S is formed in a cylinder inner surface shape and the spool 41 is reciprocally movably accommodated along the rotary axis X in the spool chamber 51S. Therefore, the spool spring 42 is disposed between the inside end of the spool 41 and the retainer 54. Thereby, the spool 41 is biased so as to project in the direction of the outer end side (direction of the bolt head 52).

In the bolt body 51, the plurality of acquisition flow passages 51*m* communicating the hydraulic oil chamber 51T and the inside space of the shaft 5T are formed and the plurality of intermediate flow passages 51*n* are formed between the hydraulic oil chamber 51T and the outer peripheral surface of the bolt body 51.

A check valve CV is provided in the flow passage sending the hydraulic oil from the acquisition flow passage 51*m* to the intermediate flow passage 51*n* in the hydraulic oil chamber 51T. This check valve CV is configured with a ball holder 61, a check spring 62, and a check ball 63.

In this check valve CV, the check spring 62 is disposed between the retainer 54 and the check ball 63 and the check ball 63 is in pressure contact with an opening of the ball holder 61 by the biasing force of the check spring 62 to close the flow passage. An oil filter 64 removing dust from the hydraulic oil flowing toward the check ball 63 is provided in the ball holder 61.

In a case where the pressure of the hydraulic oil supplied to the hydraulic oil chamber 51T exceeds the predetermined value, the check valve CV opens the flow passage against the biasing force of the check spring 62 and in a case where the pressure is decreased less than the predetermined value, the check valve CV closes the flow passage by the biasing force of the check spring 62. By this operation, when the pressure of the hydraulic oil is decreased, reverse flow of the hydraulic oil from the advance angle chamber Ca or the retard angle chamber Cb is prevented and variation of the phase of the valve opening and closing timing control apparatus A is suppressed. Even in a case where the pressure of a downstream side of the check valve CV exceeds the predetermined value, this check valve CV performs closing operation.

Solenoid Control Valve

As described above, the solenoid control valve 40 is provided with the spool 41, the spool spring 42, and the electromagnetic solenoid 44.

A plurality of pump ports 50P communicating the spool chamber 51S and the outer peripheral surface of the bolt body 51 are formed as a through hole in the bolt body 51. The plurality of advance angle ports 50A and a plurality of retard angle ports 50B communicating the spool chamber 51S and the outer peripheral surface of the sleeve 55 are formed as the through hole over the bolt body 51 and the sleeve 55 in the connecting bolt 50.

The advance angle port 50A, the pump port 50P, and the retard angle port 50B are disposed in the inner end side from the outer end side of the connecting bolt 50 in this order. The advance angle port 50A and the retard angle port 50B in the direction as viewed along the rotary axis X are formed in the overlapping positions with each other and the pump port 50P is formed in a position that does not overlap with these ports.

On the outer periphery of the sleeve 55, an annular groove is formed in which the plurality of the advance angle ports 50A communicate and the plurality of the advance angle ports 50A communicate with the plurality of the advance angle flow passages 33 from the annular groove. In the same way, on the outer periphery of the sleeve 55, the annular groove is formed in which the plurality of the retard angle ports 50B communicate and the plurality of the retard angle ports 50B communicate with the plurality of the retard angle flow passages 34 from the annular groove. Furthermore, a plurality of introduction flow passages 56 communicating the intermediate flow passage 51*n* and the pump port 50P are formed in a groove shape on the inner peripheral surface of the sleeve 55.

That is, the sleeve 55 is shaped at a dimension reaching a position covering the intermediate flow passage 51*n* from the bolt head 52 of the bolt body 51 and the introduction flow passage 56 is formed in a region avoiding the advance angle port 50A and the retard angle port 50B.

A first engaging portion 51*f* as a hole with a bag shape is formed at a position deviated from a press-fitted and fixed position of the retainer 54 in the direction along the rotary axis X in the bolt body 51, a second engaging portion 55*f* having a hole shape penetrating in the radial direction is formed, and the regulation pin 57 to engage with both portions is provided in the sleeve 55. The regulation pin 57 is press-fitted and fixed to the first engaging portion 51*f*.

Specifically, the second engaging portion 55*f* is formed in a long hole shape of which the direction along the rotary axis X is larger than the direction perpendicular thereto. A slight gap to allow relative movement in the direction along the rotary axis X of the bolt body 51 and the sleeve 55 is formed between the second engaging portion 55*f* and the regulation pin 57 from the configuration.

That is, the sleeve 55 is configured to be movable respectively only by an amount corresponding to the gap between the second engaging portion 55*f* and the regulation pin 57 in the direction along the rotary axis X with respect to the bolt body 51, while maintaining a relative posture of the rotation around the rotary axis X of the bolt body 51 and the sleeve 55. Thereby, by the pressure of the hydraulic oil acting at the end of the sleeve 55 from the hydraulic oil chamber 51T, the entire sleeve 55 is moved in the direction of the outer end side, the end of the outer end side of the sleeve 55 is in close contact to move until the end abuts on the back surface of the bolt head 52 of the bolt body 51 (portion of the driven side rotor), and thus the leakage of the hydraulic oil at this portion is suppressed.

Thereby, the relative posture of the rotation around the rotary axis X of the bolt body 51 and the sleeve 55 and a relative position thereof along the rotary axis X are determined. Accordingly, the hydraulic oil from the hydraulic oil chamber 51T may be supplied to the pump port 50P via the acquisition flow passage 51*m*, the check valve CV, the intermediate flow passage 51*n*, and the introduction flow passage 56.

The spool 41 forms an abutting surface on which the plunger 44*a* abuts on the outer end side, forms land portions 41A at two positions in the direction along the rotary axis X, and forms a groove portion 41B at an intermediate position of these land portions 41A. The spool 41 is formed in a hollow and a drain hole 41D is formed on a projecting end of the spool 41. The spool 41 abuts on a stopper 43 provided on an inner peripheral opening of the outer end side of the connecting bolt 50, so that a position of a projecting side is determined.

The solenoid control valve 40 causes the plunger 44*a* to abut on the abutting surface of the spool 41 and controls the amount of projection. Therefore, as illustrated in FIG. 3, FIG. 4, and FIG. 5, the solenoid control valve 40 is configured to be capable of setting the spool 41 at a neutral position, a retard angle position, and an advance angle position.

The spool 41 is set at the neutral position illustrated in FIG. 3, so that the advance angle port 50A and the retard angle port 50B are closed at the same time by a pair of the land portions 41A of the spool 41. As a result, the feeding and discharging of the hydraulic oil to the advance angle chamber Ca and the retard angle chamber Cb is not performed and the phase of the valve opening and closing timing control apparatus A is maintained.

Figure 4:
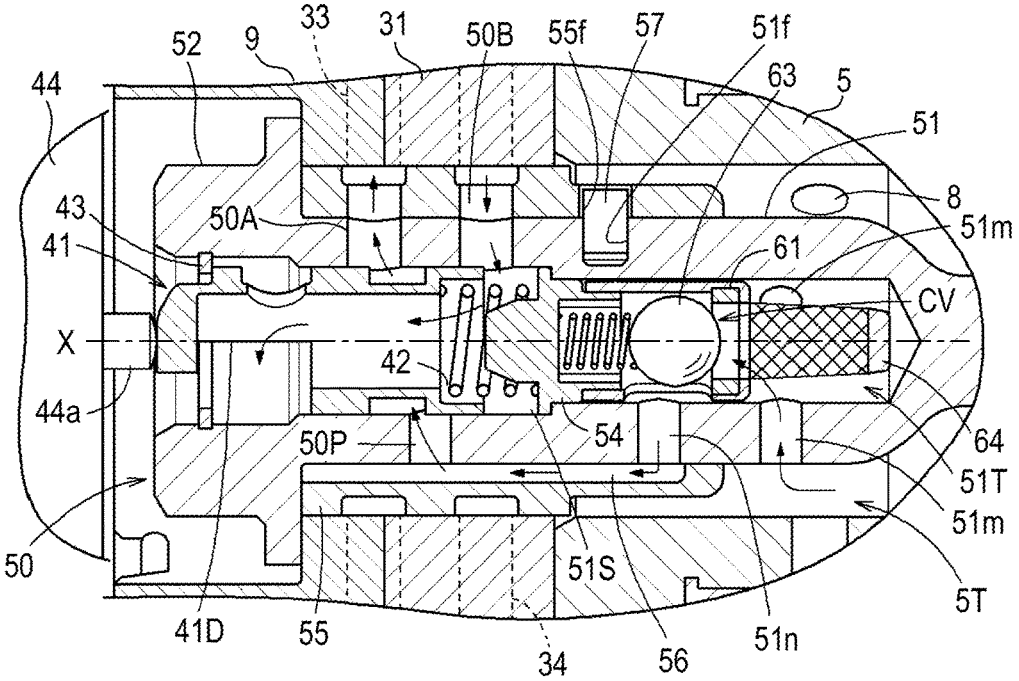
FIG. 4 is a sectional view illustrating a spool in an advance angle position.
Figure 5:
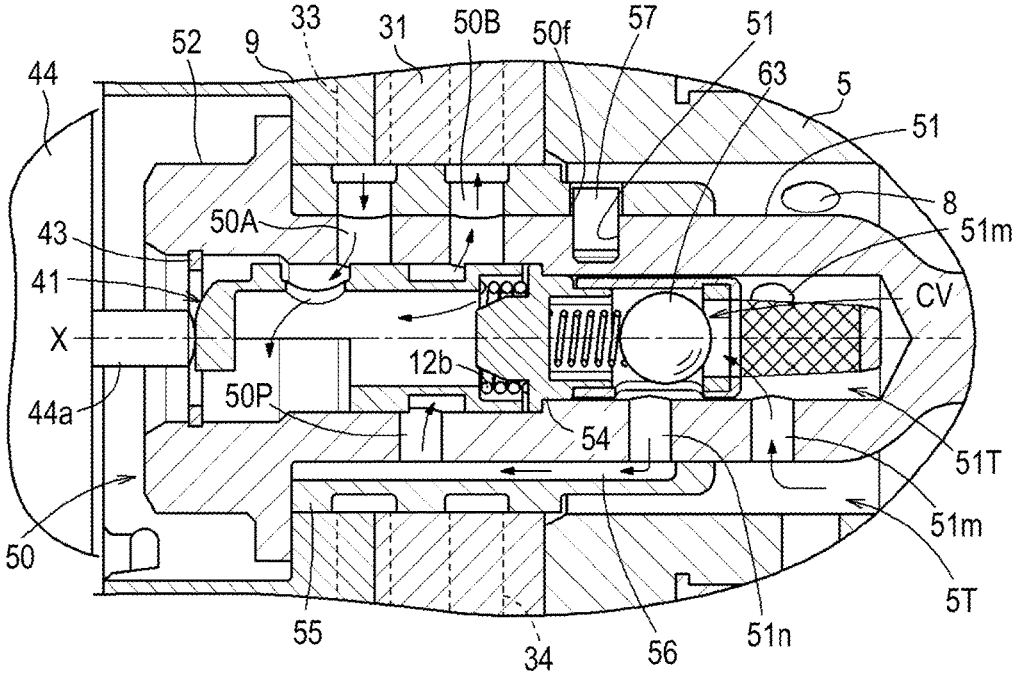
FIG. 5 is a sectional view illustrating a spool in a retard angle position.
Figure 6:
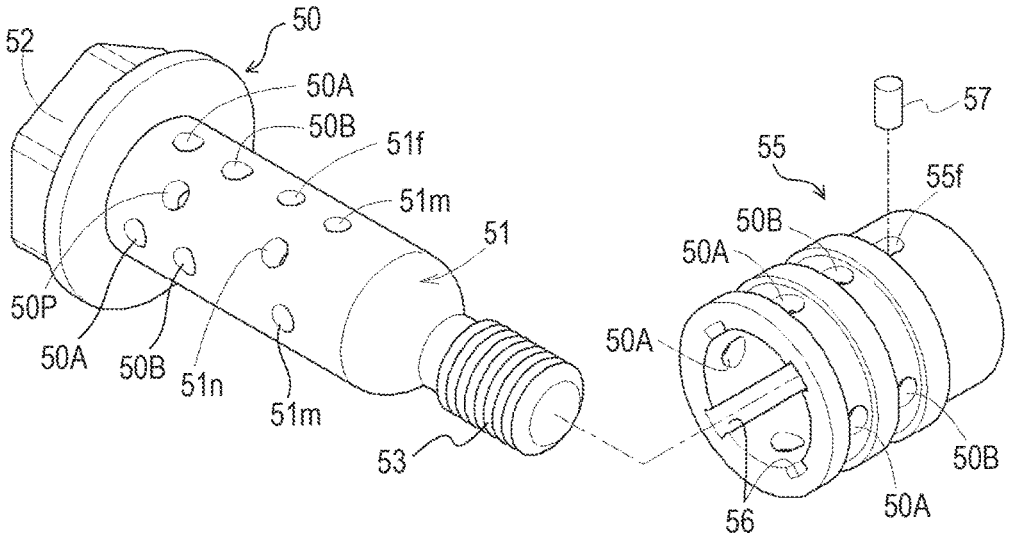
FIG. 6 is an exploded perspective view illustrating a bolt body and a sleeve.

The plunger 44*a* is retracted (operated outwards) on the basis of the neutral position by the control of the electromagnetic solenoid 44, so that the spool 41 is set at the advance angle position illustrated in FIG. 4. The pump port 50P communicates with the advance angle port 50A via the groove portion 41B at the advance angle position. At the same time, the retard angle port 50B communicates with the spool chamber 51S from the inner end of the spool 41. Thereby, the hydraulic oil is supplied to the advance angle chamber Ca, the hydraulic oil flows to the inside of the spool 41 from the retard angle chamber Cb, and the hydraulic oil is discharged from the drain hole 41D (flow of the hydraulic oil is illustrated by an arrow in FIG. 4). As a result, a rotation phase of the intake camshaft 5 is displaced in the advance angle direction Sa. The retard angle position coincides with the position in which the spool 41 abuts on the stopper 43 by the biasing force of the spool spring 42.

In a state where the locking mechanism L is in a lock state, the spool 41 is set at the advance angle position and in a case where the hydraulic oil is supplied to the advance angle flow passage 33, the hydraulic oil is supplied to the locking recess portion of the locking mechanism L from the advance angle flow passage 33. Therefore, the locking member 26 is detached from the locking recess portion and the lock state of the locking mechanism L is released.

The plunger 44*a* is projected (operated inwards) on the basis of the neutral position by the control of the electromagnetic solenoid 44, so that the spool 41 is set at the retard angle position illustrated in FIG. 5. The pump port 50P communicates with the retard angle port 50B via the groove portion 41B at the retard angle position. At the same time, the advance angle port 50A communicates with a drain space (space continued to the outer end side from the spool chamber 51S). Thereby, the hydraulic oil is supplied to the retard angle chamber Cb and at the same time the hydraulic oil is discharged from the advance angle chamber Ca (flow of the hydraulic oil is illustrated by an arrow in FIG. 5). As a result, the rotation phase of the intake camshaft 5 is displaced in the retard angle direction Sb.

Position Determination Unit

The valve opening and closing timing control apparatus A is provided with a front position determination unit FB that determines a positional relationship around the rotary axis X of the internal rotor 30 and the intermediate member 9, and a rear position determination unit RB that determines the positional relationship around the rotary axis X of the internal rotor 30 and the intake camshaft 5. The front position determination unit FB is provided with a front engaging pin 71 in a posture parallel to the rotary axis X, and the rear position determination unit RB is provided with a rear engaging pin 72 in a posture parallel with the rotary axis X. An aluminum alloy is used in the internal rotor main body 31, and a steel material is used in the intermediate member 9 and the intake camshaft.

As illustrated in FIGS. 7 to 10, a cylindrical portion 9A and a connecting wall portion 9B are integrally formed in the intermediate member 9, and a circular opening portion 9C is formed around the rotary axis X in the connecting wall portion 9B. A connecting contact surface 9*s* is formed on a surface facing the internal rotor main body 31 of the connecting wall portion 9B. An abutting contact surface 5*p* is formed on the surface facing the internal rotor main body 31 of the intake camshaft 5.

Figure 7:
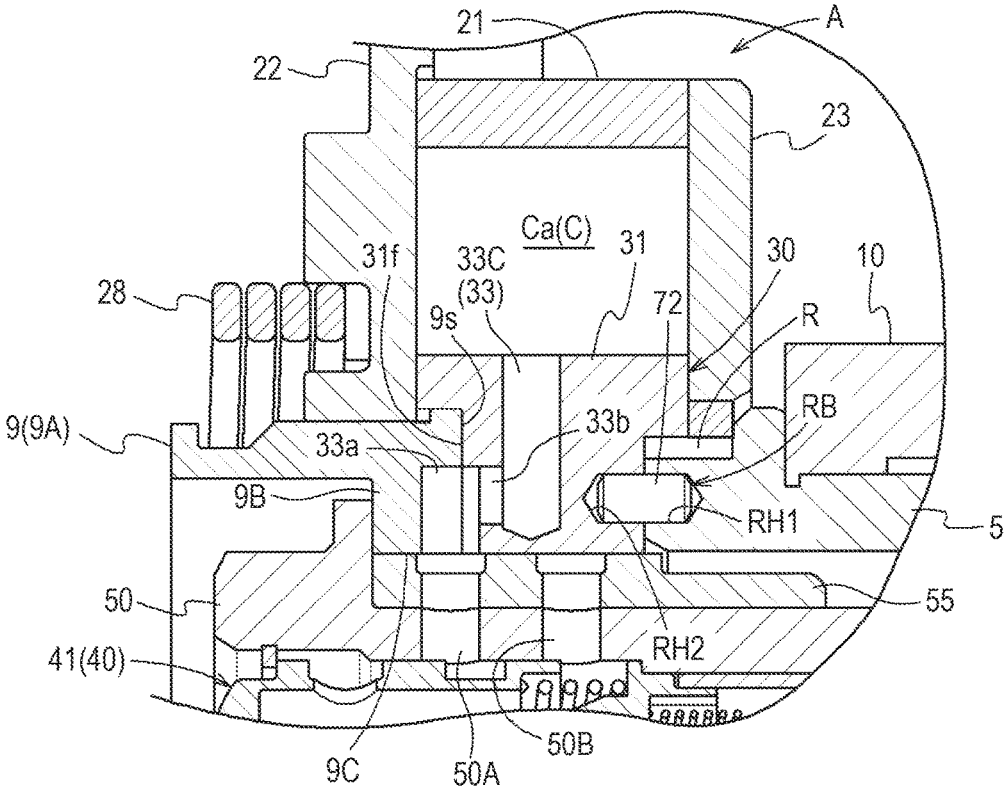
FIG. 7 is a sectional view illustrating a position of a rear connecting pin.
Figure 8:
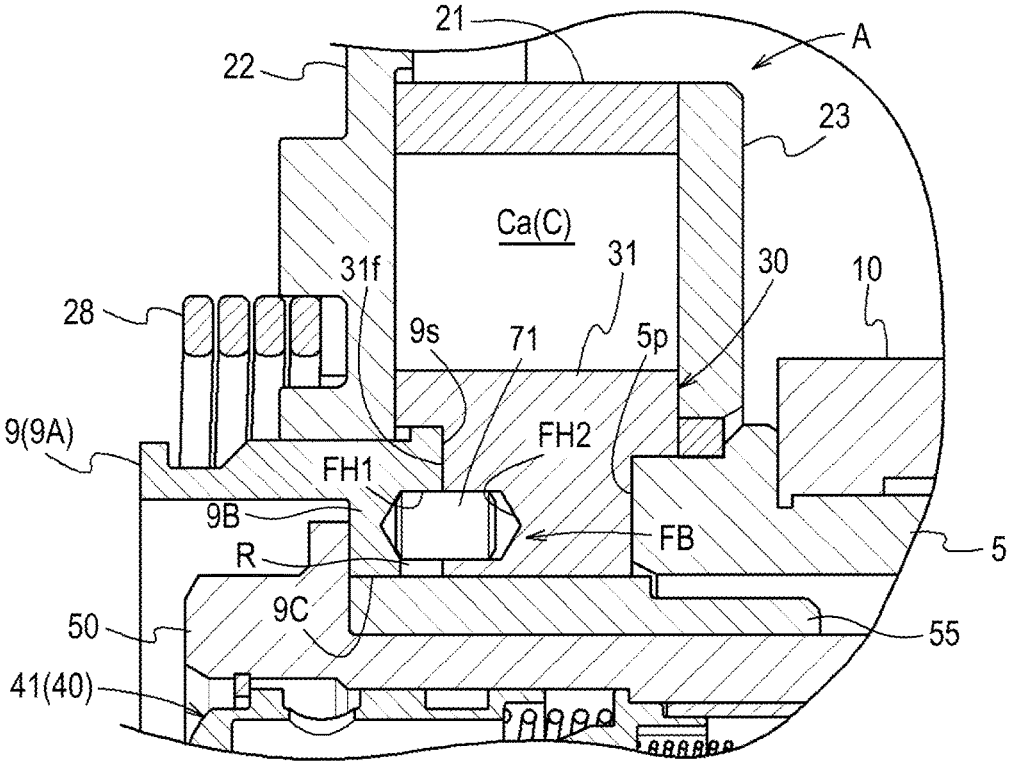
FIG. 8 is a sectional view illustrating a position of a front connecting pin.
Figure 9:
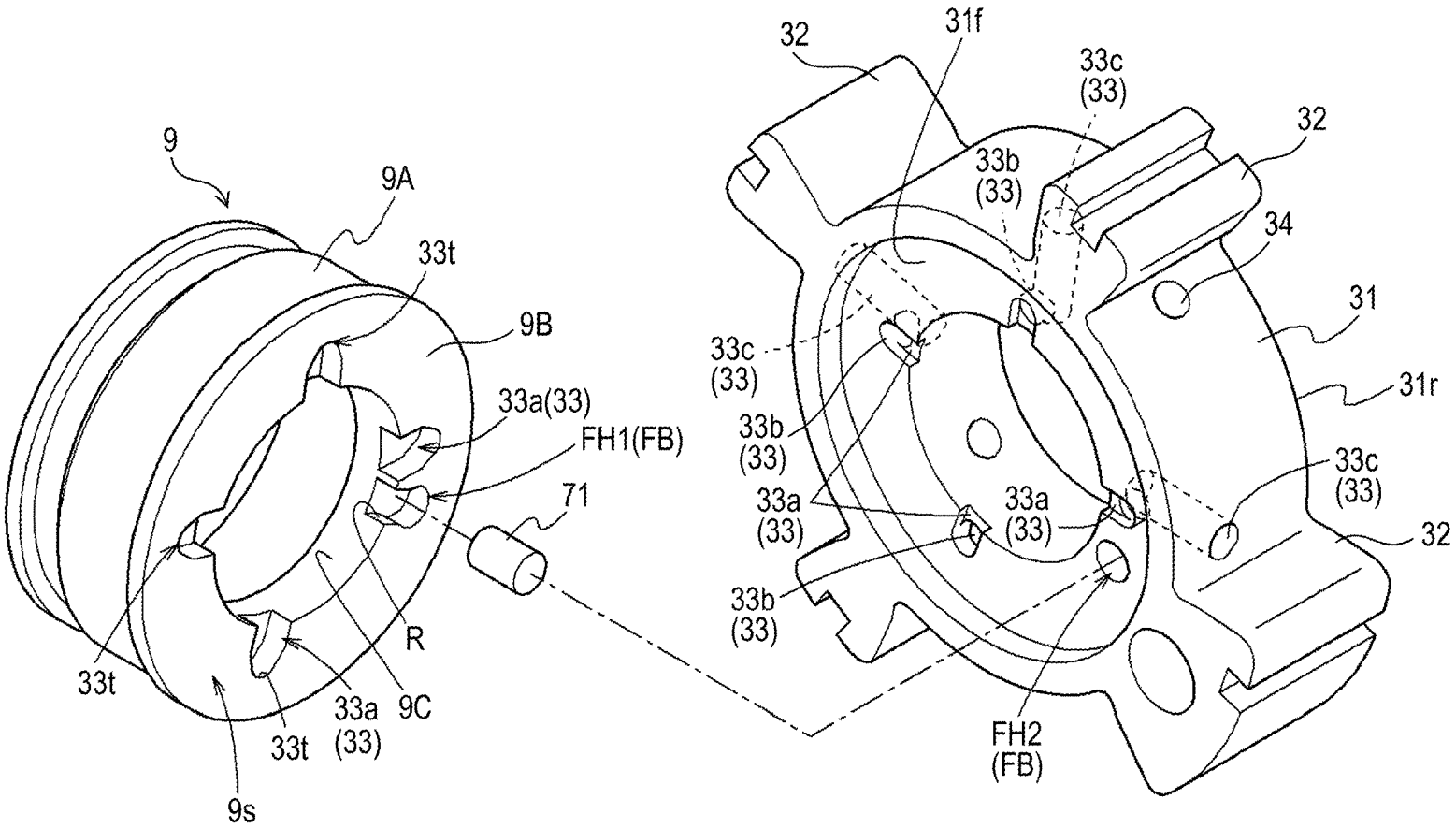
FIG. 9 is an exploded perspective view illustrating an engagement of the front connecting pin.
Figure 10:
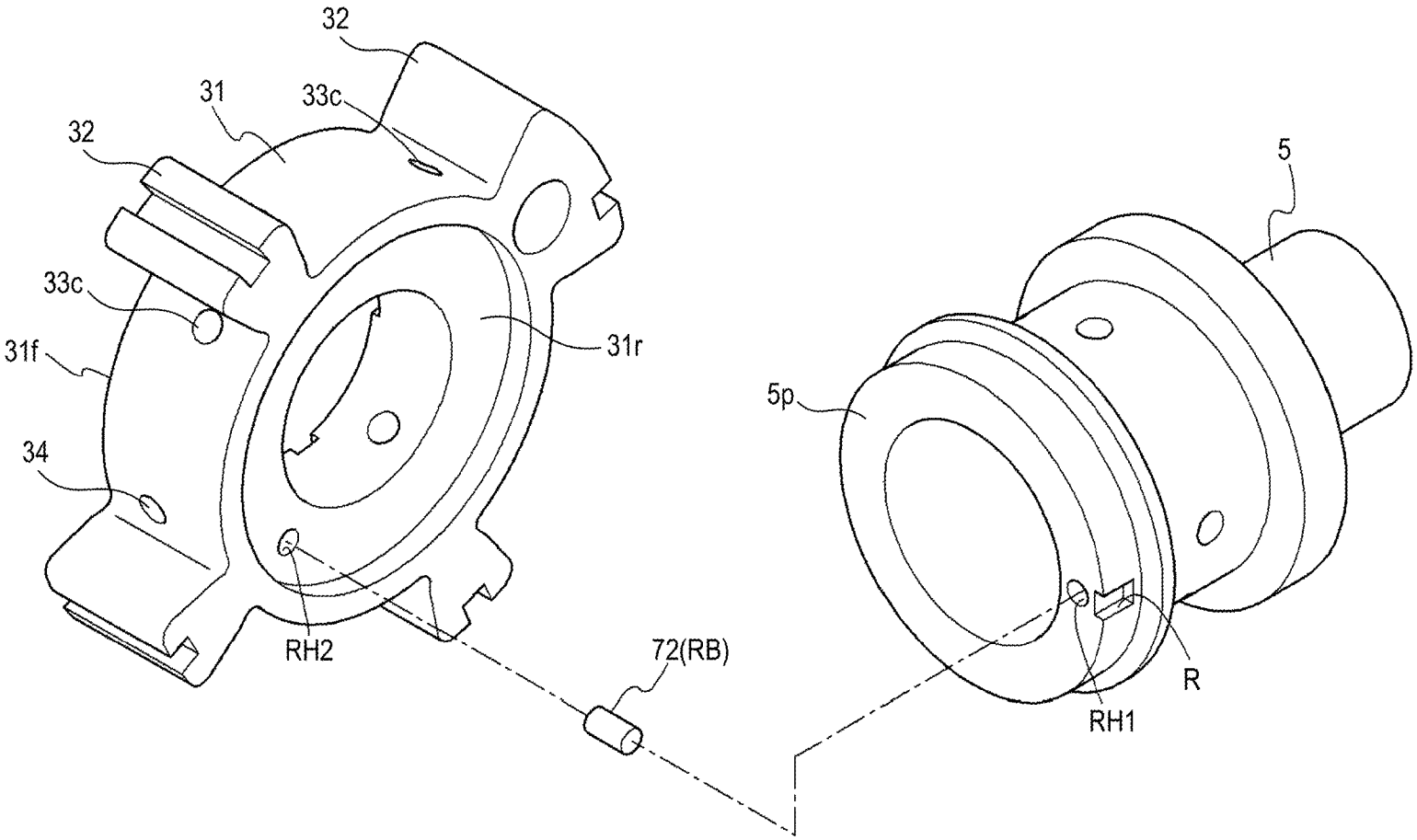
FIG. 10 is an exploded perspective view illustrating an engagement of the rear connecting pin.

As illustrated in FIGS. 8 and 9, a front contact surface 31*f* is formed in a recessed shape in which the connecting wall portion 9B is fitted, on a side where the intermediate member 9 is disposed of the internal rotor main body 31, and the connecting contact surface 9*s* of the connecting wall portion 9B is disposed in a contact state to the front contact surface 31*f*. As illustrated in FIGS. 7 and 10, a rear contact surface 31*r* is formed in a recessed shape in which the intake camshaft 5 is fitted, on a side where the intake camshaft 5 is disposed of the internal rotor main body 31, and the abutting contact surface 5*p* of the intake camshaft 5 is disposed in a contact state to the rear contact surface 31*r*.

As illustrated in FIGS. 7 and 10, the advance angle flow passage 33 is configured with a first advance angle flow passage 33*a* that is formed along a boundary part between the front contact surface 31*f* of the internal rotor main body 31 and the connecting contact surface 9*s* of the intermediate member 9 in the radial direction, a second advance angle flow passage 33*b* that is formed in the internal rotor main body 31 in a posture parallel to the rotary axis X from the outer end position of the first advance angle flow passage 33*a*, and a third advance angle flow passage 33*c* that is formed in the internal rotor main body 31 from the second advance angle flow passage 33*b* in the radial direction.

Thereby, a portion of four first advance angle flow passages 33*a* is formed in a groove shape along the radial direction on the connecting contact surface 9*s*. A portion of four first advance angle flow passages 33*a* is formed in a groove shape along the radial direction on the front contact surface 31*f* of the internal rotor main body 31. The second advance angle flow passage 33*b* and the third advance angle flow passage 33*c* communicating with the first advance angle flow passage 33*a* are formed in the inside of the internal rotor main body 31.

Position Determination Unit: Front Position Determination Unit

A front first hole portion FH1 into which one end of the front engaging pin 71 is press-fitted (fitted) is formed on the connecting contact surface 9*s* of the connecting wall portion 9B, and a deformation absorbing unit R which is configured with a slit continuing to cut and open the front first hole portion FH1 in the direction of the opening portion 9C is formed. A front second hole portion FH2 in which the other end of the front engaging pin 71 is inserted is formed on the front contact surface 31*f*. In this manner, the front position determination unit FB is provided with the front engaging pin 71, the front first hole portion FH1, the front second hole portion FH2, and the deformation absorbing unit R. The deformation absorbing unit R, without being limited to the slit, may be formed as the space with a non-slit shape extending outward of the front first hole portion FH1 (space with the groove shape continuing to the outer periphery of the front first hole portion FH1) from the outer periphery of the front first hole portion FH1.

An inner diameter of the front first hole portion FH1 is set to a value slightly smaller than an outer diameter of the front engaging pin 71, the outer peripheral surface of the front engaging pin 71 is in close contact with the inner peripheral surface of the front first hole portion FH1 (becomes a tight-fitted state) by the press-fitting, and a state that the front engaging pin 71 is fixed to the intermediate member 9 is maintained. In a case where the front engaging pin 71 is fitted in the front first hole portion FH1, the intermediate member 9 in the vicinity of the front first hole portion FH1 is deformed, and thus a portion of the opening portion 9C is inflated toward the rotary axis X in some cases.

The deformation absorbing unit R is formed to be the slit shape in order to suppress an inconvenience, in a case of being press-fitted in order to fit the front engaging pin 71, internal stress of the intermediate member 9 is applied in a direction to expand a width of the slit of the deformation absorbing unit R, and thus the deformation inflating the inner periphery of the opening portion 9C is suppressed. Thereby, the fitting accuracy of the sleeve 55 which is disposed in close contact with the inner periphery of the opening portion 9C is maintained in good state.

The inner diameter of the front second hole portion FH2 is set to a value slightly larger than the outer diameter of the front engaging pin 71, and is configured so that the slight gap is formed between the inner surface of the front second hole portion FH2 and the outer surface of the front engaging pin 71 in an inserted state.

Furthermore, the front engaging pin 71 is a pin of which a sectional shape is formed in a circular shape, and is formed in noncircular shape tapering the shape of an end position 33*t* of the first advance angle flow passage 33*a* (reducing the width by the outer periphery side of the intermediate member 9) formed on the connecting contact surface 9*s* in order to suppress an erroneous insertion of the front engaging pin 71. Such a shape of the end position 33*t* is different from the sectional shape of the front engaging pin 71 (sectional shape viewed in the direction along the rotary axis X). Therefore, it is not possible to insert the front engaging pin 71 in the portion of the end position 33*t*, and thus the inconvenience of mistaking the insertion position of the front engaging pin 71 is eliminated.

Position Determination Unit: Rear Position Determination Unit

As illustrated in FIGS. 7 and 10, a rear first hole portion RH1 into which one end of the rear engaging pin 72 is press-fitted (fitted) is formed on the abutting contact surface 5*p* in contact with the internal rotor main body 31 of the intake camshaft 5, and the deformation absorbing unit R is formed in the groove of the posture along the rotary axis X on the outer peripheral surface of the intake camshaft 5 that becomes a vicinity position of the rear first hole portion RH1. A rear second hole portion RH2 that is inserted in the other end of the rear engaging pin 72 is formed on the rear contact surface 31*r* in contact with the abutting contact surface 5*p* of the internal rotor main body 31.

In this manner, the rear position determination unit RB is configured with the rear engaging pin 72, the rear first hole portion RH1, the rear second hole portion RH2, and the deformation absorbing unit R.

An inner diameter of the rear first hole portion RH1 is set to a value slightly smaller than an outer diameter of the rear engaging pin 72, the outer peripheral surface of the rear engaging pin 72 is in close contact with the inner peripheral surface of the rear first hole portion RH1 (becomes the tight-fitted state) by the press-fitting, and a state that the rear engaging pin 72 is fixed to the intake camshaft 5 is maintained. In a case where the rear engaging pin 72 is press-fitted into the rear first hole portion RH1, the intake camshaft 5 in the vicinity of the rear first hole portion RH1 is deformed, and thus a portion of the outer periphery is inflated outward (direction away from the rotary axis X) in some cases.

The deformation absorbing unit R in the groove shape is formed to the outer periphery of the intake camshaft 5 in order to eliminate the inconvenience, in a case where the rear engaging pin 72 is press-fitted, internal stress of the intake camshaft 5 is applied in a direction to expand a width of the groove of the deformation absorbing unit R, and thus the deformation inflating the inner periphery is suppressed. Thereby, although a portion of the internal rotor main body 31 is externally fitted to the outer periphery of the intake camshaft 5, a good fitted state is maintained.

The inner diameter of the rear second hole portion RH2 is set to a value slightly larger than the outer diameter of the rear engaging pin 72, and is configured so that the slight gap is formed between the inner surface of the rear second hole portion RH2 and the outer surface of the front engaging pin 71 in an inserted state.

Action and Effect of the Embodiment

According to such a configuration, in a case of assembling the valve opening and closing timing control apparatus A, the front engaging pin 71 is press-fitted and fixed (fitted) to the front first hole portion FH1 of the intermediate member 9, and the rear engaging pin 72 is press-fitted and fixed (fitted) to the rear first hole portion RH1 of the intake camshaft 5. Thereby, the front engaging pin 71 and the rear engaging pin 72 can be stably held.

In a case of assembling the valve opening and closing timing control apparatus A, the front engaging pin 71 is inserted in the front second hole portion FH2 of the internal rotor main body 31, and thus a relative position around the rotary axis X between the internal rotor main body 31 and the intermediate member 9 is determined. In the valve opening and closing timing control apparatus A, although the sleeve 55 is disposed to be fitted in the opening portion 9C of the intermediate member 9, as described above, even if the front engaging pin 71 is press-fitted, a phenomenon of deforming so as to inflate the inner periphery of the opening portion 9C is suppressed, and thus the sleeve 55 can be surely inserted. Furthermore, a flow passage that supplies and discharges the hydraulic oil is not narrowed by the deformation.

Furthermore, at the time of the assembly, the rear engaging pin 72 is inserted in the rear second hole portion RH2 of the internal rotor main body 31, and thus a relative position around the rotary axis X between the intake camshaft 5 and the internal rotor main body 31 is determined. In the valve opening and closing timing control apparatus A, although a portion of the internal rotor main body 31 is externally fitted to the outer periphery of the intake camshaft 5, a phenomenon of deforming so as to inflate the outer periphery of the intake camshaft 5 is eliminated, and thus a work for an external fitting is smoothly performed and an accuracy of the fitting portion is highly maintained.

In this state, the connecting bolt 50 is inserted in the intermediate member 9 and the internal rotor main body 31, the male threaded portion 53 of the connecting bolt 50 is screwed to the female threaded portion 5S of the intake camshaft 5, and the connecting bolt 50 is fastened by the rotation operation. Therefore, the assembly is completed. In the assembly, work of the process such as the sleeve 55 being externally fitted to the connecting bolt 50 and the spool 41 being set to the spool chamber 51S is performed in advance.

Specifically, in this configuration, even in a case where the press-fitted member is deformed larger than expected as a case where the outer diameter of the front engaging pin 71 is greater than a design value against the inner diameter of the front first hole portion FH1, or as a case where the outer diameter of the rear engaging pin 72 is greater than a design value against the inner diameter of the rear first hole portion RH1, reasonable assembly is realized. Accordingly, it is not necessary to increase the accuracy between the front position determination unit FB and the rear position determination unit RB, and thus it is easy to manufacture.

Other Embodiment

This disclosure may be configured as follows except for the above-described embodiment (those having the same functions as the embodiment are designated with the common numbers and reference numerals as the embodiment).

(a) For example, in the valve opening and closing timing control apparatus A configured to dispose the intermediate member with a ring shape between the internal rotor main body 31 and the intake camshaft 5 (it may be the exhaust camshaft), the configuration of this disclosure may be applied to the position determining unit that performs positioning in the rotation direction between the intermediate member with the ring shape and the internal rotor main body 31, or to the position determining unit that performs positioning in the rotation direction between the member with the ring shape and the intake camshaft 5.

(b) The deformation absorbing unit R may be any of the inner periphery and the outer periphery of the member in which a first hole portion is formed. The deformation absorbing unit R may be formed respectively on the inner periphery and the outer periphery of the member.

(c) In a case where an engaging pin is press-fitted into the member, insofar as a portion of the member is configured to suppress the inflated deformation, the deformation absorbing unit R may be the hole portion or the recessed portion formed in the vicinity of a first engaging hole portion, without being limited to the slit or the groove. The deformation absorbing unit R may be formed as a space (space with non-slit shape) which is formed in a groove shape along the first hole portion to the outer periphery of the first hole portion, by extending outward from the outer periphery of the first hole portion.

A valve opening and closing timing control apparatus according to an aspect of this disclosure includes a driving side rotor that synchronously rotates with a crankshaft of an internal combustion engine, a driven side rotor that is disposed coaxially with a rotary axis of the driving side rotor and synchronously rotates with a camshaft for valve opening and closing, a connecting bolt that is disposed coaxially with the rotary axis, and connects the driven side rotor to the camshaft, and a position determination unit that performs positioning between the driven side rotor and the camshaft, or in a case where an intermediate member is provided between the driven side rotor and the camshaft, between the driven side rotor and the intermediate member, or between the camshaft and the intermediate member. The position determination unit includes an engaging pin that is in a posture parallel to the rotary axis, a first hole portion into which one end of the engaging pin is fitted is provided in any one of two members performing the positioning, a second hole portion in which the other end of the engaging pin is inserted is provided in the other one, and a deformation absorbing unit that suppresses deformation at a time when the engaging pin is fitted is provided in the vicinity of the first hole portion.

According to this configuration, by fitting the one end side of the engaging pin in the first hole portion, it is possible to support stably the engaging pin. By inserting the other end side of the engaging pin in the second hole portion, a positional relationship between a member in which the first hole portion is formed and a member in which the second hole portion is formed is determined. In a case where the engaging pin is fitted in the first hole portion, even if the member in which the first hole portion is formed is low strength material such as aluminum, and is significantly deformed at the time when the engaging pin is press-fitted, the deformation absorbing unit suppresses the deformation of the member in which the first hole portion is formed.

Accordingly, the valve opening and closing timing control apparatus in which when connecting the members to each other in the positioning state, the inconvenience caused by the press-fitting of the engaging pin is eliminated is configured.

In the aspect of this disclosure, the deformation absorbing unit may be configured with a groove that is formed in a posture parallel to the rotary axis at a position adjacent to an outer periphery of the first hole portion.

According to this configuration, in a case where the engaging pin is fitted in the first hole portion, and even in a case where an error between the inner diameter of the first hole portion and the outer diameter of the engaging pin is large and thus the deformation is caused around the first hole portion, it is possible to concentrate stress generating the deformation on the groove. Thereby, for example, in the configuration in which the first hole portion is formed in parallel to the hole portion in which the connecting bolt is inserted, a groove portion is formed along the first hole portion on a side opposite to the position of the hole portion. Therefore, it is possible for the vicinity of the groove portion to be significantly deformed more than other portions, and thus the deformation of the hole portion in which the connecting bolt is inserted can be suppressed.

In the aspect of this disclosure, the deformation absorbing unit may be configured with a space extending outward from an outer periphery of the first hole portion.

According to this configuration, in a case where the engaging pin is fitted in the first hole portion, and even in a case where an error between the inner diameter of the first hole portion and the outer diameter of the engaging pin is large and thus the deformation is caused around the first hole portion, it is possible to concentrate the stress generating the deformation in the space extending outward from the outer periphery of the first hole portion. Thereby, for example, in the configuration in which the first hole portion is formed in parallel to the hole portion in which the connecting bolt is inserted, the space extending outward from the outer periphery of the first hole portion is formed along the first hole portion. Therefore, it is possible for the vicinity of the space to be significantly deformed more than other portions, and thus the deformation of the hole portion in which the connecting bolt is inserted can be suppressed. The space extending outward from the outer periphery of the first hole portion includes a space formed in a slit shape so as to cut and open the outer periphery of the first hole portion, and a space formed in a groove shape extending outward only by setting value in the radial direction from the outer periphery of the first hole portion.

In the aspect of this disclosure, a flow passage that supplies and discharges a hydraulic oil to an advance angle chamber or a retard angle chamber formed between the driving side rotor and the driven side rotor is formed in the driving side rotor or the intermediate member, and a sectional shape of the flow passage along the rotary axis direction may be different from a sectional shape of the engaging pin.

According to this configuration, for example, in a work fitting artificially the engaging pin in the first hole portion in a manufacturing process, even in a case where an attempt for fitting the engaging pin erroneously in the advance angle flow passage and the retard angle flow passage, the engagement is not possible, and thus the inconvenience that performs erroneously a fitting operation is eliminated.

This disclosure may be used for the valve opening and closing timing control apparatus positioning a plurality of members disposed along the rotary axis by the engaging pin.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A valve opening and closing timing control apparatus comprising:

a driving side rotor that synchronously rotates with a crankshaft of an internal combustion engine;

a driven side rotor that is disposed coaxially with a rotary axis of the driving side rotor and synchronously rotates with a camshaft for valve opening and closing;

a connecting bolt that is disposed coaxially with the rotary axis, and connects the driven side rotor to the camshaft; and a position determination unit that performs positioning between the driven side rotor and the camshaft, or in a case where an intermediate member is provided between the driven side rotor and the camshaft, between the driven side rotor and the intermediate member, or between the camshaft and the intermediate member, wherein the position determination unit includes an engaging pin that is in a posture parallel to the rotary axis, a first hole portion into which one end of the engaging pin is fitted is provided in any one of two members in the driven side rotor, the camshaft, and the intermediate member performing the positioning, a second hole portion in which the other end of the engaging pin is inserted is provided in an other of the two members, and a deformation absorbing unit that suppresses deformation at a time when the engaging pin is fitted is provided at any one of the two members at which the first hole portion is provided, the deformation absorbing unit being provided on a cross-section parallel to and passing through the rotary axis and an axial center of the engaging pin.

2. The valve opening and closing timing control apparatus according to claim 1, wherein the deformation absorbing unit is configured with a groove that is formed in a posture parallel to the rotary axis at a position adjacent to an outer periphery of the first hole portion.

3. The valve opening and closing timing control apparatus according to claim 2, wherein a flow passage that supplies and discharges a hydraulic oil to an advance angle chamber or a retard angle chamber formed between the driving side rotor and the driven side rotor is formed in the driving side rotor or the intermediate member, and wherein a sectional shape of the flow passage along the rotary axis direction is different from a sectional shape of the engaging pin.

4. The valve opening and closing timing control apparatus according to claim 1, wherein the deformation absorbing unit is configured with a space extending outward from an outer periphery of the first hole portion.

5. The valve opening and closing timing control apparatus according to claim 4, wherein a flow passage that supplies and discharges a hydraulic oil to an advance angle chamber or a retard angle chamber formed between the driving side rotor and the driven side rotor is formed in the driving side rotor or the intermediate member, and wherein a sectional shape of the flow passage along the rotary axis direction is different from a sectional shape of the engaging pin.

6. The valve opening and closing timing control apparatus according to claim 1, wherein a flow passage that supplies and discharges a hydraulic oil to an advance angle chamber or a retard angle chamber formed between the driving side rotor and the driven side rotor is formed in the driving side rotor or the intermediate member, and wherein a sectional shape of the flow passage along the rotary axis direction is different from a sectional shape of the engaging pin.

7. The valve opening and closing timing control apparatus according to claim 1, wherein the deformation absorbing unit is positioned at a radially inner side or a radially outer side of the engaging pin on the cross-section passing through the rotary axis and the axial center of the engaging pin.

8. The valve opening and closing timing control apparatus according to claim 1, wherein the deformation absorbing unit is positioned adjacent to the engaging pin as viewed along the rotary axis.

9. A valve opening and closing timing control apparatus comprising:

a driving side rotor that synchronously rotates with a crankshaft of an internal combustion engine;

a driven side rotor that is disposed coaxially with a rotary axis of the driving side rotor and synchronously rotates with a camshaft for valve opening and closing;

a connecting bolt that is disposed coaxially with the rotary axis, and connects the driven side rotor to the camshaft; and a position determination unit that performs positioning between the driven side rotor and the camshaft, or in a case where an intermediate member is provided between the driven side rotor and the camshaft, between the driven side rotor and the intermediate member, or between the camshaft and the intermediate member, wherein the position determination unit includes an engaging pin that is in a posture parallel to the rotary axis, a first hole portion into which one end of the engaging pin is fitted is provided in a first member, a second hole portion in which the other end of the engaging pin is inserted is provided in a second member, and a deformation absorbing unit that suppresses deformation at a time when the engaging pin is fitted is provided at the first member, the deformation absorbing unit being provided on a cross-section parallel to and passing through the rotary axis and an axial center of the engaging pin, wherein the first member comprises the driven side rotor, the camshaft, or the intermediate member, wherein when the first member comprises the driven side rotor, the second member comprises the camshaft or the intermediate member, wherein when the first member comprises the camshaft, the second member comprises the driven side rotor or the intermediate member, and wherein when the first member comprises the intermediate member, the second member comprises the camshaft or the driven side member.

* * * * *